US011982271B2

(12) United States Patent
Hu et al.

(10) Patent No.: US 11,982,271 B2
(45) Date of Patent: May 14, 2024

(54) SCROLL COMPRESSOR, VEHICLE AIR CONDITIONER AND VEHICLE

(71) Applicant: GREE GREEN REFRIGERATION TECHNOLOGY CENTER CO., LTD. OF ZHUHAI, Guangdong (CN)

(72) Inventors: Yusheng Hu, Zhuhai (CN); Huijun Wei, Zhuhai (CN); Yun Liu, Zhuhai (CN); Xiaoli Kang, Zhuhai (CN); Caixia Shan, Zhuhai (CN); Shuanglai Liu, Zhuhai (CN); Xiaoshan Chen, Zhuhai (CN); Xuefeng Li, Zhuhai (CN)

(73) Assignee: GREE GREEN REFRIGERATION TECHNOLOGY CENTER CO., LTD. OF ZHUHAI, Guangdong (CN)

( * ) Notice: Subject to any disclaimer, the term of this patent is extended or adjusted under 35 U.S.C. 154(b) by 217 days.

(21) Appl. No.: 17/604,429

(22) PCT Filed: Dec. 27, 2019

(86) PCT No.: PCT/CN2019/129029
§ 371 (c)(1),
(2) Date: Oct. 17, 2021

(87) PCT Pub. No.: WO2020/248578
PCT Pub. Date: Dec. 17, 2020

(65) Prior Publication Data

US 2022/0213893 A1 Jul. 7, 2022

(30) Foreign Application Priority Data

Jun. 10, 2019 (CN) ..... 201910497272.X

(51) Int. Cl.
*F04C 18/02* (2006.01)
*F04C 29/00* (2006.01)

(52) U.S. Cl.
CPC ..... *F04C 18/0215* (2013.01); *F04C 2240/30* (2013.01); *F04C 2240/50* (2013.01); *F04C 2240/60* (2013.01)

(58) Field of Classification Search
CPC ..... F04C 18/0215; F04C 18/0253; F04C 18/0207; F04C 18/0246; F04C 29/0057; F04C 27/009
See application file for complete search history.

(56) References Cited

U.S. PATENT DOCUMENTS

2003/0147763 A1* 8/2003 Sakuda ..... F04C 18/0276 418/55.1
2005/0129558 A1 6/2005 Makino et al.
2006/0153725 A1* 7/2006 Koide ..... F04C 29/026 418/55.6

FOREIGN PATENT DOCUMENTS

CN 104696217 A 6/2015
CN 104989650 A 10/2015
(Continued)

OTHER PUBLICATIONS

English translation of KR20170042131 by PE2E May 11, 2023.*
(Continued)

*Primary Examiner* — Deming Wan
(74) *Attorney, Agent, or Firm* — J. Miguel Hernandez; James R. Gourley; Carstens, Allen & Gourley, LLP

(57) ABSTRACT

Scroll compressor, a vehicle air conditioner and a vehicle are disclosed. The scroll compressor includes a first end cover, a casing and a crankshaft. The casing is provided with a supporting portion having a first bearing mounting portion; the first end cover is provided with a second bearing mounting portion; a first end of the crankshaft is arranged in the first bearing mounting portion through a first bearing; a second end of the crankshaft is arranged in the second bearing mounting portion through a second bearing; and the
(Continued)

first bearing mounting portion and the second bearing mounting portion cooperate with each other to form an axial limitation on the crankshaft.

16 Claims, 5 Drawing Sheets

(56) References Cited

FOREIGN PATENT DOCUMENTS

| | | | | | |
|---|---|---|---|---|---|
| CN | 204704109 | U | | 10/2015 | |
| CN | 206234122 | U | | 6/2017 | |
| CN | 207229385 | U | | 4/2018 | |
| CN | 208040698 | U | | 11/2018 | |
| CN | 208749538 | U | | 4/2019 | |
| CN | 110107499 | A | | 8/2019 | |
| JP | 2013245621 | A | | 12/2013 | |
| KR | 20170042131 | A | * | 4/2017 | ..... F04C 29/02 |
| WO | WO-2012098624 | A1 | * | 7/2012 | ..... F01C 21/10 |
| WO | 2017057159 | A1 | | 4/2017 | |

OTHER PUBLICATIONS

English translation of WO-2012098624 by PE2E May 11, 2023.*
English copy of KR20170042131 by PE2E translation, Jan. 23, 2024.*
1 Extended European Search Report for European Application No. 19932284.3 dated Mar. 29, 2022 (9 pages).

* cited by examiner

SCROLL COMPRESSOR, VEHICLE AIR CONDITIONER AND VEHICLE

RELATED APPLICATION

This application claims all benefits accruing under 35 U.S.C. § 119 from China Patent Application No. 201910497272.X, filed on Jun. 10, 2019, in the China National Intellectual Property Administration, the entire content of which is hereby incorporated by reference. This application is a national phase under 35 U.S.C. § 120 of international patent application PCT/CN2019/129029, entitled "Scroll Compressor, Vehicle Air Conditioner and Vehicle" filed on Dec. 27, 2019, and published as WO 2020/248578 on Dec. 17, 2020, the content of which is also hereby incorporated by reference. Every patent application and publication listed in this paragraph is hereby incorporated by reference in its entirety as an example.

TECHNICAL FIELD

The present disclosure relates to the technical field of air compression, in particular, to a scroll compressor, a vehicle air conditioner and a vehicle.

BACKGROUND TECHNOLOGY

Along with the gradual popularity of new energy vehicles, requirements and specifications for components and parts of the new energy vehicles are becoming more and more stringent. A compressor is a key component of a vehicle air-conditioning system, and performance of the compressor directly affects the application of the entire air-conditioning system, and vibration noise most affects application experience. As a focus point of research, development and application of an onboard compressor, reducing vibration noise of the compressor has become consensus of manufacturers of the onboard compressors. For compressors used in the new energy vehicles, in order to increase endurance ability of a battery, it is also particularly important to reduce weight of all components and parts. Therefore, most compressors for the new energy vehicles on the market are scroll compressors made of lightweight material (aluminum alloy).

The related technology discloses technology of a vehicle scroll compressor. In the compressor, a driving motor, a driving spindle, a bearing supporting portion and a working pump body are assembled and fixed together in a casing. A main bearing is mounted in the bearing supporting portion, and a crankshaft passes through the main bearing to drive the pump body to work. Both axial and circumferential restrictions on the bearing supporting portion and the pump body are achieved by an axial pressing force of an end cover of the casing.

The assemble of the above technical solution is simple, and the bearing supporting portion is disposed in the casing by means of a lap joint, to support the shaft system and the pump body, but the indirect fixing and restricting force is small and uneven, as the pressing force for fixing the bearing support portion is provided indirectly only by a bolt pre-tightening force of the end cover of the casing, and. When the bolt tightening force is uneven, or the bolt loosens, the pre-tightening and restricting force provided by the bolt tightening force is even more uneven, and this situation definitely occurs during actual operation of the assembly. Therefore, compared with a restriction by direct fixing, the scheme of the above structure has the problem that vibration of the shaft system is large, and thus resulting in loud noise of the compressor.

SUMMARY OF THE INVENTION

Therefore, the technical problem to be solved by the present disclosure is to provide a scroll compressor, a vehicle air conditioner and a vehicle, which may reduce drifting of a shaft system caused by a small restricting force during operation of the compressor and effectively reduce mechanical noise of the compressor.

In order to solve the above problems, the present disclosure provides a scroll compressor, including a first end cover, a casing and a crankshaft. The casing is provided with a supporting portion having a first bearing mounting portion. The first end cover is provided with a second bearing mounting portion, a first end of the crankshaft is arranged in the first bearing mounting portion through a first bearing, and a second end of the crankshaft is arranged in the second bearing mounting portion through a second bearing, and the first bearing mounting portion and the second bearing mounting portion cooperate with each other to form an axial limitation on the crankshaft.

In an embodiment, a motor and an orbiting scroll are arranged inside the casing. The motor is located at a first end of the supporting portion. The orbiting scroll is located at a second end of the supporting portion. The supporting portion is provided with a suction passage communicating chambers at a side where the motor is located and at a side where the orbiting scroll of the casing is located.

In an embodiment, the supporting portion further includes an orbiting scroll supporting seat, and the scroll compressor further includes an orbiting scroll arranged on the orbiting scroll supporting seat.

In an embodiment, the supporting portion is an annular protrusion protruding radially from an inner wall of the casing. The first bearing mounting portion is arranged at a first end of the annular protrusion, and the orbiting scroll supporting seat is arranged at a second end of the annular protrusion.

In an embodiment, the second end of the annular protrusion is further provided with a rotation prevention mounting portion configured to mount a rotation prevention structure, and the rotation prevention structure is configured to prevent the orbiting scroll from rotating.

In an embodiment, the rotation prevention mounting portion includes a pin hole arranged in an end surface of the second end of the annular protrusion, and the self-rotation prevention structure includes a rotation prevention pin disposed in the pin hole.

In an embodiment, an eccentric shaft is disposed at an end portion of the first end of the crankshaft; an eccentric sleeve is arranged over the eccentric shaft and disposed in a through hole of the supporting portion; and the orbiting scroll is sleeved over the eccentric sleeve.

In an embodiment, the casing includes a first casing and a second casing. The first casing is provided with a first bearing mounting portion, a rotation prevention mounting portion and an orbiting scroll supporting seat; a motor stator is fixedly arranged on the second casing. The first casing and the second casing are separately arranged and fixedly connected together.

In an embodiment, the first bearing mounting portion, the rotation prevention mounting portion, the orbiting scroll supporting seat and the first casing are integrally formed.

In an embodiment, the first casing is provided with a first connecting flange. The second casing is provided with a second connecting flange. The first connecting flange and the second connecting flange are fixedly connected by bolts.

In an embodiment, the supporting portion and the casing are integrally formed.

In an embodiment, the casing is further provided with a fixed scroll supporting seat. The scroll compressor further comprises a fixed scroll arranged in the fixed scroll supporting seat.

In an embodiment, the fixed scroll supporting seat and the casing are integrally formed.

In an embodiment, the fixed scroll supporting seat is provided with a fixed scroll positioning hole, and the fixed scroll is circumferentially positioned in the fixed scroll supporting seat by a positioning pin disposed in the fixed scroll positioning hole.

In an embodiment, the fixed scroll supporting seat is arranged at a side of the fixed scroll from which teeth of the fixed scroll protrude, and a tooth base of the fixed scroll is arranged in the fixed scroll supporting seat.

In an embodiment, the fixed scroll supporting seat has a stepped groove, and the fixed scroll is disposed in the stepped groove. The scroll compressor further includes a second end cover, and the second cover is arranged on a supporting end surface of the fixed scroll supporting seat.

In an embodiment, the fixed scroll is fixedly connected to the fixed scroll supporting seat by screws.

In an embodiment, the fixed scroll is pressed and fixed in the fixed scroll supporting seat by the second end cover.

In an embodiment, the fixed scroll is fixedly connected to the second end cover by screws.

In an embodiment, an outer circumference of the fixed scroll extends to an outer circumferential surface of the casing; the scroll compressor further includes a second end cover; and the fixed scroll is disposed between the second end cover and the fixed scroll supporting seat, and is pressed and fixed by the second end cover.

Based on the same conception, the present disclosure further provides a vehicle air conditioner including the scroll compressor described above.

Based on the same conception, the present disclosure further provides a vehicle including the vehicle air conditioner described above.

The scroll compressor provided in the present disclosure includes a first end cover, a casing and a crankshaft. The casing is provided with a supporting portion having a first bearing mounting portion. The first end cover is provided with a second bearing mounting portion, a first end of the crankshaft is arranged in the first bearing mounting portion through a first bearing, and a second end of the crankshaft is arranged in the second bearing mounting portion through a second bearing. The first bearing mounting portion and the second bearing mounting portion cooperate with each other to form an axial limitation on the crankshaft. One end of the crankshaft of the scroll compressor is supported by the first bearing in the first bearing mounting portion of the casing, and another end of the crankshaft is supported by the second bearing in the second bearing mounting portion of the first end cover, so that an axial limitation on the crankshaft may be formed at two ends thereof, thereby forming an effective limitation on the shaft system, reducing the drifting of the shaft system caused by the small restricting force during the operation of the compressor, ensuring the rotation center of the crankshaft to be stable, and solving the problem of loud noise of vibrations caused by the deviation of the rotation center of the crankshaft in a high-speed rotating state.

Figure 1:
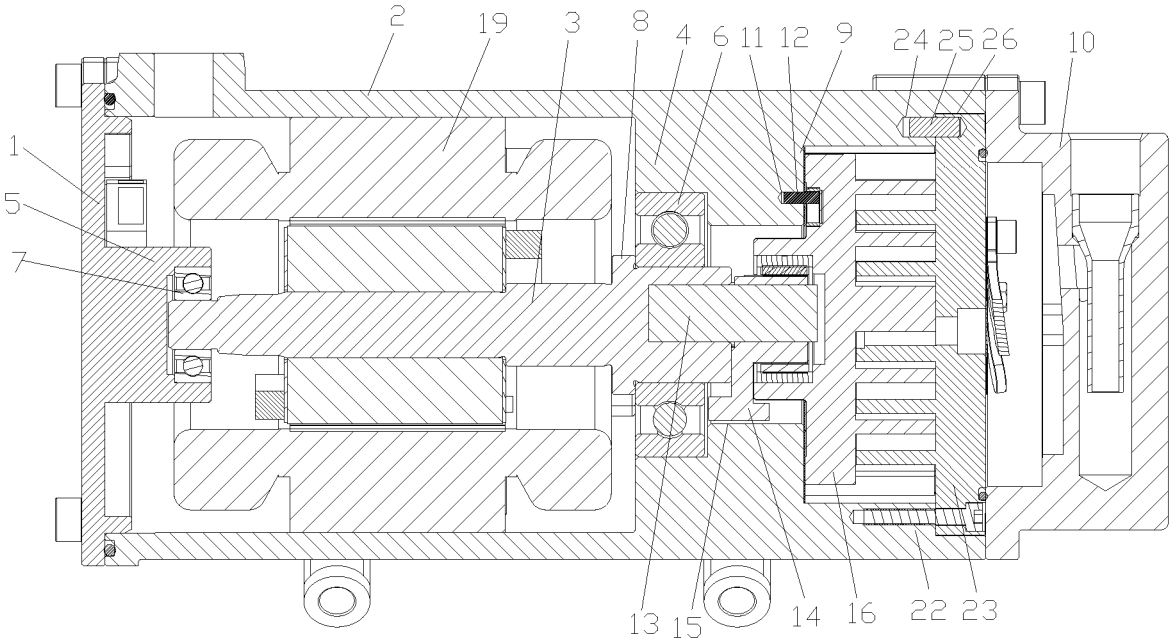
FIG. 1 is a schematic structural section of a scroll compressor of the present disclosure.
Figure 2:
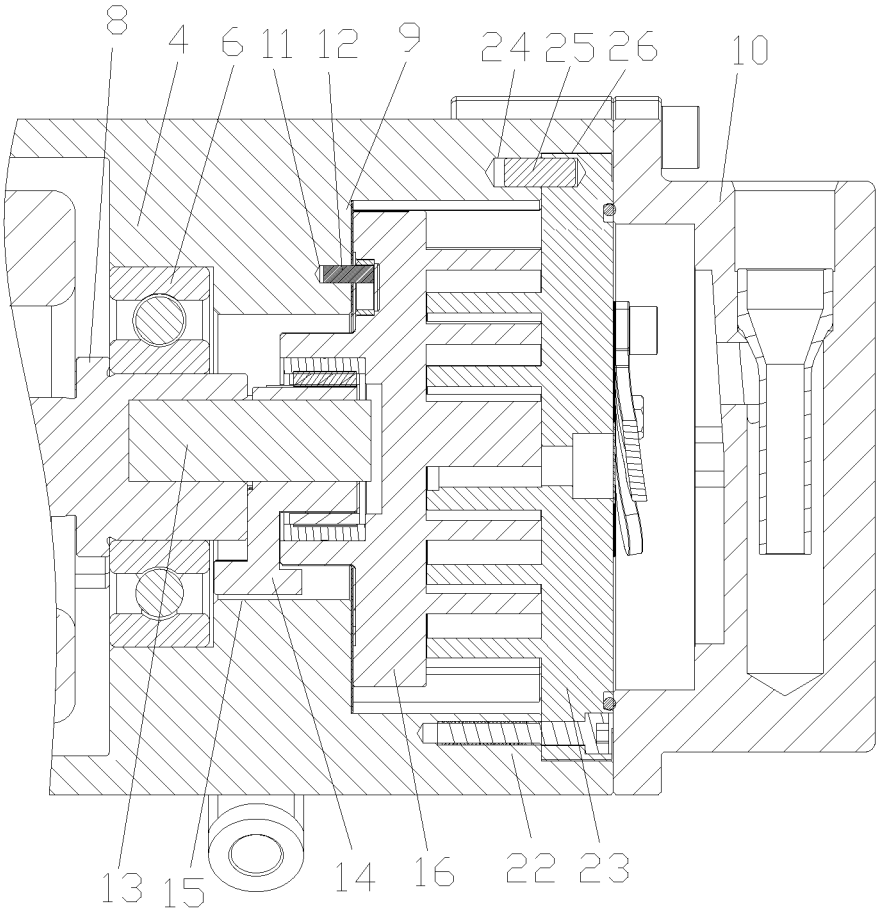
FIG. 2 is a partially enlarged schematic structural view of the scroll compressor of the present disclosure.
Figure 3:
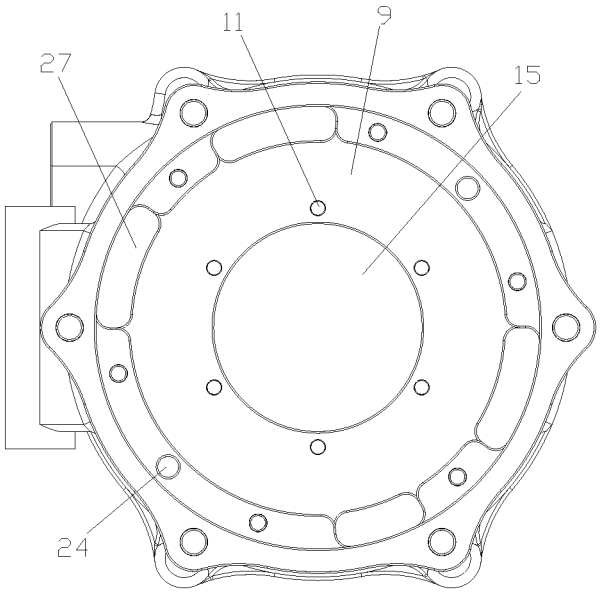
FIG. 3 is a schematic structural view of a supporting portion of the scroll compressor of the present disclosure.
Figure 4:
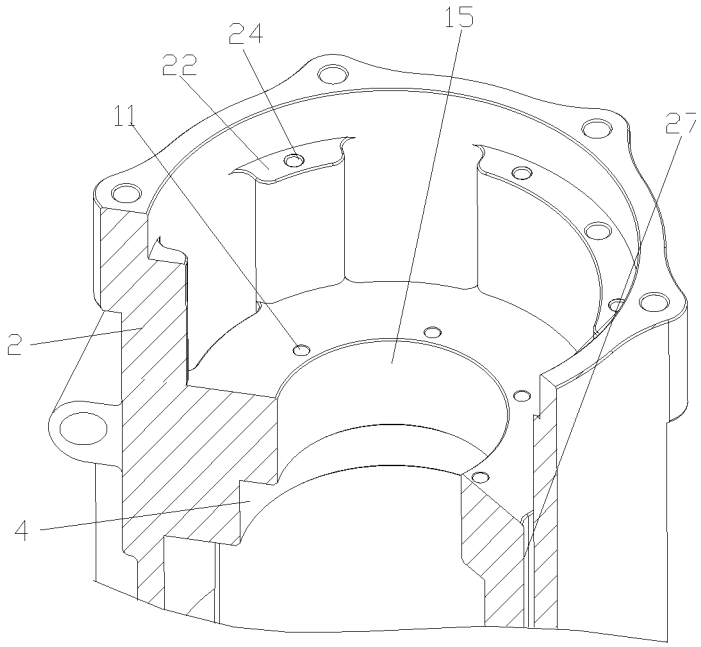
FIG. 4 is a schematic structural section of a casing of the scroll compressor of the present disclosure.

Where: 1. first end cover; 2. casing; 3. crankshaft; 4. first bearing mounting portion; 5. second bearing mounting portion; 6. first bearing; 7. second bearing; 8. stopping step; 9. orbiting scroll supporting seat; 10. second end cover; 11. pin hole; 12. self-rotation prevention pin; 13. eccentric shaft; 14. eccentric sleeve; 15. through hole; 16. orbiting scroll; 17. first casing; 18. second casing; 19. motor stator; 20. first connecting flange; 21. second connecting flange; 22. fixed scroll supporting seat; 23. fixed scroll; 24. fixed scroll positioning hole; 25. positioning pin; 26. stepped groove; 27. suction passage.

DETAILED DESCRIPTION OF THE EMBODIMENTS

To facilitate understanding of the present disclosure, the present disclosure will be described in more detail below with reference to the accompanying drawings. Some embodiments of the present disclosure are shown in the accompanying drawings. However, the present disclosure may be implemented in many different forms, and is not limited to the embodiments described herein. Instead, these embodiments are provided for the purpose of a more thorough and complete understanding of the disclosure of this present disclosure.

Referring to FIGS. 1 to 8, according to an embodiment of the present disclosure, a scroll compressor includes a first end cover 1, a casing 2 and a crankshaft 3. The casing 2 is provided with a supporting portion having a first bearing mounting portion 4, and the first end cover 1 is provided with a second bearing mounting portion 5. A first end of the crankshaft 3 is arranged in the first bearing mounting portion 4 through a first bearing 6, and a second end of the crankshaft 3 is arranged in the second bearing mounting portion 5 through a second bearing 7. The first bearing mounting portion 4 and the second bearing mounting portion 5 cooperate with each other to form an axial limitation on the crankshaft 3.

One end of the crankshaft 3 of the scroll compressor is supported by the first bearing 6 in the first bearing mounting portion 4 of the casing 2, and another end of the crankshaft 3 is supported by the second bearing 7 in the second bearing mounting portion 5 of the first end cover 1, so that an axial limitation on the crankshaft 3 may be formed at two ends thereof, thereby forming an effective limitation on the shaft system, reducing the drifting of the shaft system caused by the small restricting force during the operation of the compressor, ensuring the rotation center of the crankshaft 3 to be stable, and solving the problem of loud noise of vibrations caused by the deviation of the rotation center of the crankshaft 3 in a high-speed rotating state.

A motor and an orbiting scroll 16 are arranged inside the casing 2. The motor is disposed at a first end of the supporting portion, the orbiting scroll 16 is disposed at a second end of the supporting portion, and the supporting portion is provided with a suction passage 27 communicating chambers at a side where the motor is located and at a side where the orbiting scroll of the casing 2 is located. After refrigerant enters the casing 2 through a suction port of the casing 2, it flows from the motor side, passes through the suction passage 27 and enters the orbiting scroll side, and then enters a compression chamber. The refrigerant is compressed into high-pressure air under the squeezing action of the orbiting scroll 16 and the fixed scroll 23, and is discharged from an exhaust port. In an embodiment, the suction passage 27 is arranged in the outer circumference of the supporting portion and extends in an axial direction of the supporting portion. In an embodiment, the suction passage 27 is arranged at a join of the supporting portion and the casing 2. In an embodiment, the suction passage 27 is an arc-shaped groove, and a plurality of suction passages 27 are uniformly distributed along a circumferential direction of the supporting portion.

Referring to FIG. 1 to 4, according to an embodiment of the present disclosure, the first end of the crankshaft 3 is provided with a stopping step 8. The first bearing 6 is sleeved over the first end of the crankshaft 3, and forms an axial restriction on the crankshaft 3 by means of the stopping step 8.

In an embodiment, two ends of the crankshaft 3 are provided with stopping steps 8, respectively wherein an axial limitation is formed between the stopping step 8 at the first end of the crankshaft 3 and the first bearing 6. A bearing mounting opening is formed in the first bearing mounting portion 4, and opens towards the stopping step 8. The first bearing 6 is mounted in the bearing mounting opening. The step of the bearing mounting opening forms an axial limitation on the first bearing 6, and thus forming an axial limitation on the stopping step 8 by means of the first bearing 6, and defining the axial limitation on the first end of the crankshaft 3.

An axial limitation is formed between the stopping step at the second end of the crankshaft 3 and the second bearing 7. Since the second bearing 7 is mounted in the second bearing mounting portion 5 of the first end cover 1, the axial limitation on the second end of the crankshaft 3 may be formed by the pressing action from the first end cover 1.

By arranging the supporting portion inside the casing 2, the axial limitation may be formed on the first end of the crankshaft 3, so as to cooperate with the axial restriction provided at the second end of the crankshaft 3 itself to form restrictions on both ends of the crankshaft 3 in the axial direction, thereby effectively avoiding the drifting of the crankshaft 3 during operation and ensuring stability and reliability during its movement.

In an embodiment, the supporting portion further includes an orbiting scroll supporting seat 9, and the scroll compressor further includes an orbiting scroll 16 arranged on the orbiting scroll supporting seat 9. In an embodiment, the orbiting scroll supporting seat 9 for supporting the orbiting scroll 16, and the first bearing mounting portion 4 for supporting the first bearing 6 are designed as an integral structure, which may ensure that relative positions of the rotation center of the crankshaft and the compression center of the pump body profile are stable and have high accuracy, thus further reducing mechanical noise of the pump body during operation, improving the positioning accuracy between the orbiting and fixed scrolls and the driving crankshaft, and greatly improving consistency of compressor performance.

The supporting portion is an annular protrusion which protrudes radially from the inner wall of the casing 2. The first bearing mounting portion 4 is arranged at the first end of the annular protrusion, and the orbiting scroll supporting seat 9 is arranged at the second end of the annular protrusion. By configuring the supporting portion to be a structure of the annular protrusion, it is possible to utilize structural features of the annular protrusion to arrange the first bearing mounting portion 4 and the orbiting scroll supporting seat 9 at two ends of the annular protrusion, respectively. Therefore, the first bearing 6 and the orbiting scroll 16 are spaced apart by the annular protrusion, thereby facilitating the axially limitation on the first bearing 6 and a support for the orbiting scroll 16.

The second end of the annular protrusion is further provided with a rotation prevention mounting portion for mounting a rotation prevention structure which is used for preventing the orbiting scroll 16 from rotating around its axis. The rotation prevention mounting portion may be used for mounting a rotation prevention structure, so that the rotation of the orbiting scroll 16 is restricted by the rotation prevention structure. Since the rotation prevention mounting portion is located in the supporting portion, the rotation prevention mounting portion and the orbiting scroll supporting seat 9 may be integrally designed, which may easily achieve consistency of a rotation prevention design with the supporting structure of the orbiting scroll 16, and improve motion accuracy and motion performance of the orbiting scroll 16.

In an embodiment, the rotation prevention mounting portion includes a pin hole 11 arranged in an end surface of the second end of the annular protrusion, and the rotation prevention structure includes a rotation prevention pin 12 arranged in the pin hole 11. By matching the rotation prevention pin 12 with the pin hole 11, rotation preventing accuracy of the orbiting scroll 16 may be improved, motion accuracy of the orbiting scroll 16 may be improved, the rotation prevention structure may be simplified, and the manufacturing cost may be reduced. A plurality of pin holes 11 may be arranged in the end surface of the second end of the annular protrusion along the circumferential direction, so that a more stable and reliable rotation prevention control may be formed. In an embodiment, the rotation prevention structure may also be designed as a cross-ring-shaped structure for preventing the orbiting scroll 16 from rotating, and a corresponding structure may still be conveniently arranged in the supporting portion.

An eccentric shaft 13 is disposed at an end portion of the first end of the crankshaft 3; an eccentric sleeve 14 is arranged over the eccentric shaft 13 and is disposed in a through hole 15 of the supporting portion. The orbiting scroll 16 is sleeved over the eccentric sleeve 14.

In an embodiment, the supporting portion and the casing 2 are integrally formed, which may make structural matching between the supporting portion and the casing 2 more stable, and make coaxiality between the crankshaft 3 and the orbiting scroll 16 to be more easily realized during machining, and thereby more efficiently ensuring the crankshaft rotation center to be stable, and reducing the vibration noise caused by the deviation of the rotation center of the crankshaft in the high-speed rotation state.

A fixed scroll supporting seat 22 is further arranged on the casing 2, and the scroll compressor further includes a fixed scroll 23 disposed on the fixed scroll supporting seat 22.

In an embodiment, the fixed scroll supporting seat 22 and the casing 2 are integrally formed. The orbiting scroll supporting seat 9, the first bearing mounting portion 4, the rotation prevention mounting portion, and the fixed scroll supporting seat 22 may be integrally formed with the casing 2, so that the entire structure is integrated. What's more, positioning structures of the crankshaft 3 and the orbiting and fixed scrolls may be more reasonably designed, thus effectively ensuring coaxiality among these components, reducing vibrations during movement, and reducing vibration noise.

A fixed scroll positioning hole 24 is arranged on the fixed scroll supporting seat 22. The fixed scroll 23 is circumferentially positioned in the fixed scroll supporting seat 22 by a positioning pin 25 disposed in the fixed scroll positioning hole 24.

The fixed scroll supporting seat 22 is arranged at a side of the fixed scroll 23 from which teeth of the fixed scroll 23 protrude, and a tooth base of the fixed scroll 23 is arranged in the fixed scroll supporting seat 22. Six to eight bolt connection holes are arranged in the outer part of the fixed scroll along a circumferential direction. Bolt threaded holes are correspondingly arranged on fixed scroll supporting seat 22 of the casing 2. The fixed scroll 23 is fixedly connected to the fixed scroll supporting seat 22 by means of the fixed scroll pre-tightening bolts, so as to realize axial and radial restrictions and fastenings of the fixed scroll 23. And, the fixed scroll supporting portion is provided with one to two fixed scroll positioning holes functioning as a circumferential positioning structure, which is used for positioning the fixed scroll 23 on the casing 2 by a positioning pin. An exhaust region is formed behind the back of the fixed scroll 23 and is sealed by a sealing component arranged between the fixed scroll 23 and the second end cover 10. Moreover, the second end cover 10 and the casing 2 are connected by bolts.

In an embodiment, the fixed scroll supporting seat 22 has a stepped groove 26, and the fixed scroll 23 is arranged in the stepped groove 26. The scroll compressor further includes a second end cover 10, and the second end cover 10 is arranged on the supporting end surface of the fixed scroll supporting seat 22. In an embodiment, the axial and radial restriction and fastening of the fixed scroll 23 are formed primarily by screws which are fixedly connected to the fixed scroll supporting seat 22. The second end cover 10 is fixedly connected to the supporting end surface of the fixed scroll supporting seat 22, and a seal between the second end cover 10 and the fixed scroll 23 is achieved by a sealing member.

The refrigerant enters the compressor through the suction port of the compressor, and then refrigerates the driving motor firstly or enters the orbiting scroll and the fixed scroll to be compressed, and finally discharged into pipelines of the refrigerant system through the exhaust port.

A suction circulating groove passes through the fixed scroll supporting seat 22 and the first bearing mounting portion 4, and communicates with the suction region of the motor inside the casing 2, so as to achieve suction compression of the pump body.

Figure 5:
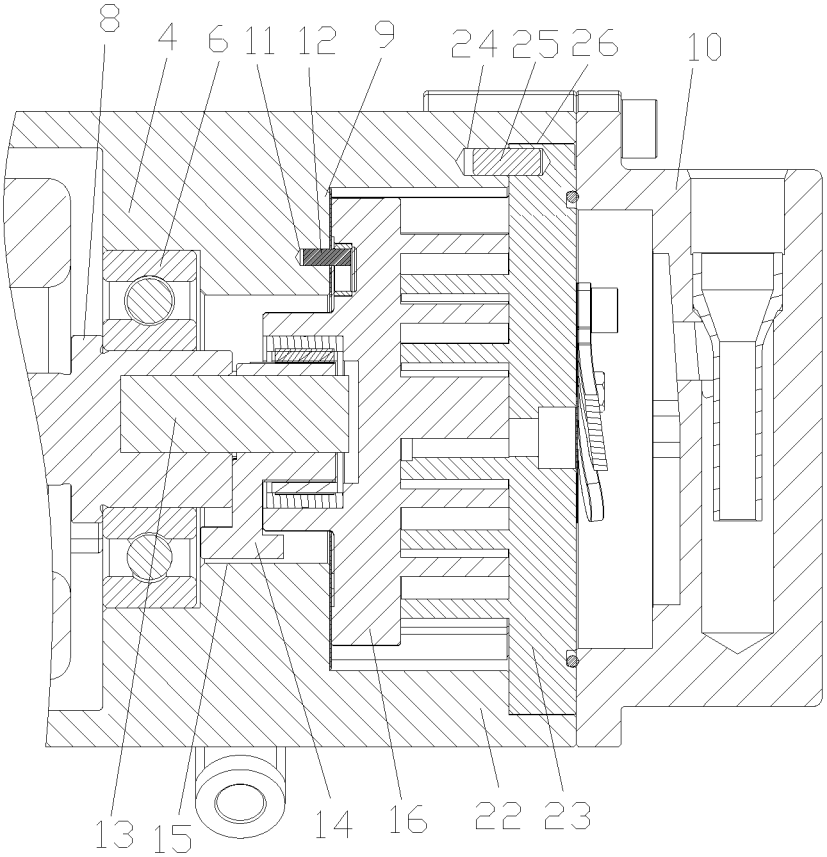
FIG. 5 is a schematic structural view of the scroll compressor of the present disclosure.

Referring to FIG. 5, according to an embodiment of the present disclosure, the fixed scroll supporting seat 22 is configured only to support and position the fixed scroll 23, but not form the axial limitation on the fixed scroll 23. The axial limitation on the fixed scroll 23 is realized by the means of the second end cover 10 pressing against the end surface of the fixed scroll 23. In an embodiment, no bolts are arranged between the fixed scroll 23 and the casing 2 may be omitted, thereby reducing the production cost of the scroll compressor in the case that the bolt connection between the casing 2 and the second end cover 10 is reliable.

Figure 6:
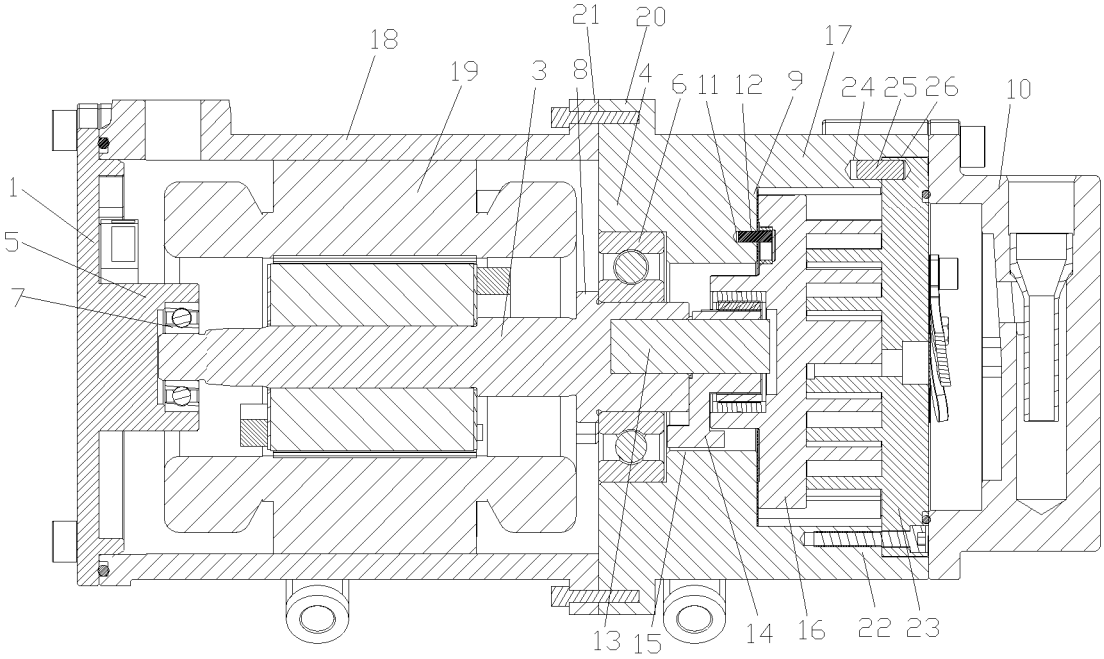
FIG. 6 is a partially enlarged structural view of a motor rotor of the present disclosure.

Referring to FIG. 6, according to an embodiment of the present disclosure, the casing 2 includes a first casing 17 and a second casing 18. The first bearing mounting portion 4, the rotation prevention mounting portion and the orbiting scroll supporting seat 9 are disposed on the first casing 17. The motor stator 19 is fixedly disposed on the second casing 18. The first casing 17 and the second casing 18 are separately arranged and fixedly connected together.

In an embodiment, the casing 2 is provided as a split structure mainly for the following reasons. On the one hand, such a structure may avoid too large axial dimension of the integrated casing 2 which will result in difficulty in machining and casting the structure of the first bearing mounting portion 4 and cause the problem of casting gas holes. On the other hand, the first casing 17 may be formed by a die casting process with better molding effect, and the second casing 18 having a lower structural strength requirement may be conventionally casted. In this way, reliability of the compressor may be improved and the production cost may be effectively reduced.

In an embodiment, the first bearing mounting portion 4, the rotation prevention mounting portion, the orbiting scroll supporting seat 9 and the first casing 17 are integrally formed.

In an embodiment, the first casing 17 is provided with a first connecting flange 20. The second casing 18 is provided with a second connecting flange 21. The first connecting flange 20 and the second connecting flange 21 are fixedly connected by bolts. By means of the first connecting flange 20 provided at a side of the first casing 17 fitting the second casing 18, and the second connecting flange 21 provided at a side of the second casing 18 fitting the first casing 17, the first casing 17 may be fixedly connected to the second casing 18 by bolts, thereby facilitating assembling and disassembling of the first casing 17 and the second casing 18.

Figure 7:
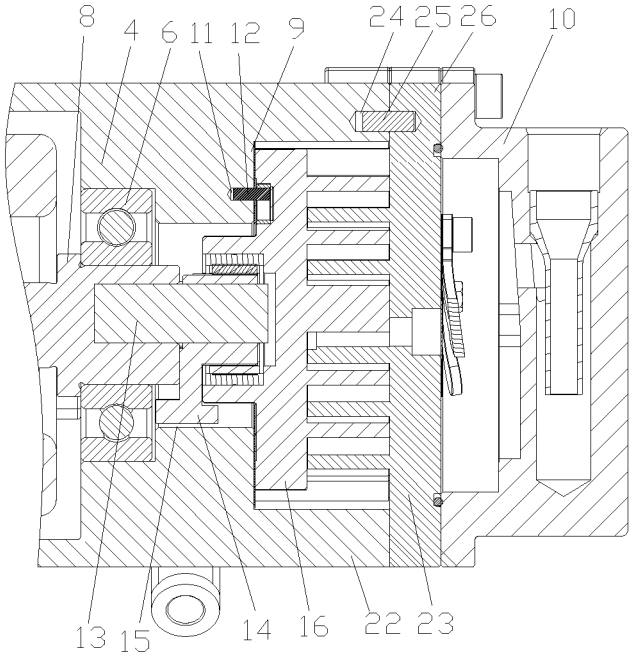
FIG. 7 is a partially enlarged structural view of a motor rotor of the present disclosure.

Referring to FIG. 7, according to an embodiment of the present disclosure, the outer circumference of the fixed scroll 23 extends to the outer circumferential surface of the casing 2. The scroll compressor further includes the second end cover 10. The fixed scroll 23 is disposed between the second end cover 10 and the fixed scroll supporting seat 22, and is pressed and fixed by the second end cover 10.

In an embodiment, the end surface of the fixed scroll supporting seat 22 for supporting the second end cover is a flat surface. The outer circumference of the fixed scroll 23 extends to the outer circumferential surface of the casing 2. The bolt passes through the fixed scroll 23 and the second end cover 10 and then is fixedly connected to the casing 2. The fixed scroll 23 is fastened by the press of the second end cover 10.

Figure 8:
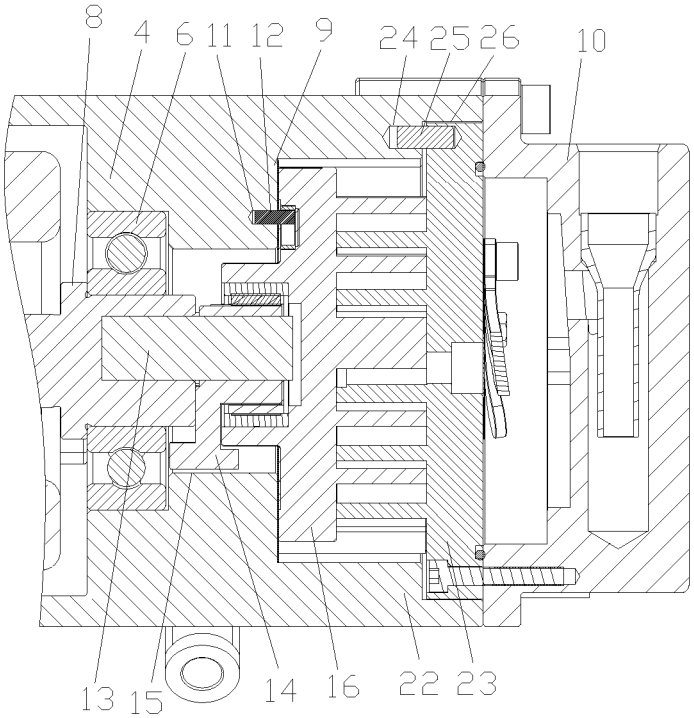
FIG. 8 is a schematic structural view of an outer rotor of a motor rotor of the present disclosure.

Referring to FIG. 8, according to an embodiment of the present disclosure, the fixed scroll 23 is fixedly connected to the second end cover 10 by screws. The second end cover 10 is fixedly connected to the casing 2 by bolts, thereby realizing fixed installation of the fixed scroll 23.

According to an embodiment of the present disclosure, a vehicle air conditioner includes the scroll compressor described above.

According to an embodiment of the present disclosure, a vehicle includes a vehicle air conditioner described above.

It should be noted that, in this disclosure, relational terms such as "first" and "second" are used only to distinguish one entity or operation from another, without necessarily requiring or implying any such actual relationship or order between these entities or operations.

The technical features of the above-described embodiments may be arbitrarily combined. For the sake of brevity of description, all possible combinations of the technical features of the above-described embodiments are not described. However, as long as the combinations of the technical features are not contradictory, they should be considered as the scope of the present specification.

The above-described embodiments express only several embodiments of the present disclosure, which are described more specifically and in detail, but cannot be interpreted as a limitation on the scope of the patent disclosure. It should be noted that, for those of ordinary skill in the art, several modifications and improvements may be made without departing from the concepts of the present disclosure, which all fall within the protection scope of the present disclosure. Accordingly, the scope of protection of the present disclosure should be subject to the scope of the appended claims.

What is claimed is:

1. A scroll compressor, comprising a first end cover, a casing and a crankshaft; wherein:

the casing is provided with a supporting portion having a first bearing mounting portion; the first end cover is provided with a second bearing mounting portion; a first end of the crankshaft is arranged in the first bearing mounting portion through a first bearing; a second end of the crankshaft is arranged in the second bearing mounting portion through a second bearing; and the first bearing mounting portion and the second bearing mounting portion cooperate with each other to form an axial limitation on the crankshaft, the casing is further provided with a fixed scroll supporting seat; the scroll compressor further comprises a fixed scroll arranged in the fixed scroll supporting seat;

the fixed scroll supporting seat is arranged at a side of the fixed scroll from which teeth of the fixed scroll protrude, and a tooth base of the fixed scroll is arranged in the fixed scroll supporting seat; and wherein the fixed scroll supporting seat has a stepped groove, and the fixed scroll is disposed in the stepped groove; and the scroll compressor further comprises a second end cover, and the second end cover is arranged on a supporting end surface of the fixed scroll supporting seat.

2. The scroll compressor according to claim 1, wherein: a motor and an orbiting scroll are arranged inside the casing; the motor is located at a first end of the supporting portion; the orbiting scroll is located at a second end of the supporting portion; and the supporting portion is provided with a suction passage communicating chambers at a side where the motor is located and at a side where the orbiting scroll of the casing is located.

3. The scroll compressor according to claim 1, wherein the supporting portion further comprises an orbiting scroll supporting seat, and the scroll compressor further comprises an orbiting scroll arranged on the orbiting scroll supporting seat.

4. The scroll compressor according to claim 3, wherein: the supporting portion is an annular protrusion protruding radially from an inner wall of the casing; the first bearing mounting portion is arranged at a first end of the annular protrusion; and the orbiting scroll supporting seat is arranged at a second end of the annular protrusion.

5. The scroll compressor according to claim 4, wherein the second end of the annular protrusion is further provided with a rotation prevention mounting portion configured to mount a rotation prevention structure, and the rotation prevention structure is configured to prevent the orbiting scroll from rotating.

6. The scroll compressor according to claim 5, wherein the rotation prevention mounting portion comprises a pin hole arranged in an end surface of the second end of the annular protrusion, and the rotation prevention structure comprises a rotation prevention pin disposed in the pin hole.

7. The scroll compressor according to claim 3, wherein: an eccentric shaft is disposed at an end portion of the first end of the crankshaft; an eccentric sleeve is arranged over the eccentric shaft and disposed in a through hole of the supporting portion; and the orbiting scroll is sleeved over the eccentric sleeve.

8. The scroll compressor according to claim 1, wherein: the casing comprises a first casing and a second casing; the first casing is provided with the first bearing mounting portion, a rotation prevention mounting portion and an orbiting scroll supporting seat; a motor stator is fixedly arranged on the second casing; and the first casing and the second casing are separately arranged and fixedly connected together.

9. The scroll compressor according to claim 8, wherein the first bearing mounting portion, the rotation prevention mounting portion, the orbiting scroll supporting seat and the first casing are integrally formed.

10. The scroll compressor according to claim 8, wherein: the first casing is provided with a first connecting flange; the second casing is provided with a second connecting flange; and the first connecting flange and the second connecting flange are fixedly connected by bolts.

11. The scroll compressor according to claim 1, wherein the fixed scroll supporting seat is provided with a fixed scroll positioning hole, and the fixed scroll is circumferentially positioned in the fixed scroll supporting seat by a positioning pin disposed in the fixed scroll positioning hole.

12. The scroll compressor according to claim 1, wherein the fixed scroll is fixedly connected to the fixed scroll supporting seat by screws.

13. The scroll compressor according to claim 1, wherein the fixed scroll is pressed and fixed in the fixed scroll supporting seat by the second end cover.

14. The scroll compressor according to claim 1, wherein the fixed scroll is fixedly connected to the second end cover by screws.

15. The scroll compressor according to claim 1, wherein: an outer circumference of the fixed scroll extends to an outer circumferential surface of the casing; the scroll compressor further comprises a second end cover; and the fixed scroll is disposed between the second end cover and the fixed scroll supporting seat, and is pressed and fixed by the second end cover.

16. An air conditioner, comprising the scroll compressor according to claim 1.

* * * * *